US012097399B2

(12) United States Patent
Bell

(10) Patent No.: US 12,097,399 B2
(45) Date of Patent: Sep. 24, 2024

(54) PORTABLE AQUATIC EXERCISE DEVICE

(71) Applicant: Michael Bell, Chicago, IL (US)

(72) Inventor: Michael Bell, Chicago, IL (US)

( * ) Notice: Subject to any disclaimer, the term of this patent is extended or adjusted under 35 U.S.C. 154(b) by 220 days.

(21) Appl. No.: 17/853,480

(22) Filed: Jun. 29, 2022

(65) Prior Publication Data

US 2024/0001190 A1 Jan. 4, 2024

(51) Int. Cl.
*A63B 21/06* (2006.01)
*A63B 21/00* (2006.01)

(52) U.S. Cl.
CPC ..... *A63B 21/0602* (2013.01); *A63B 21/4035* (2015.10)

(58) Field of Classification Search
CPC ..... A63B 21/0602; A63B 21/072; A63B 21/00065; A63B 21/4035; A63B 2071/00694; A63B 2210/50
See application file for complete search history.

(56) References Cited

U.S. PATENT DOCUMENTS 3,781,007 A 12/1973 Baker
4,357,009 A 11/1982 Baker
6,099,441 A * 8/2000 Bonnet ..... A63B 21/0602 482/106
6,149,555 A 11/2000 Kinback
7,828,703 B1 * 11/2010 Boesch ..... A63B 21/4049 482/93
D696,735 S 12/2013 Jaider
8,727,951 B2 5/2014 Jones
8,960,125 B1 * 2/2015 Brown ..... A01K 7/00 119/72
9,287,356 B2 7/2016 Jaider
11,707,661 B1 * 7/2023 Magrino ..... A63B 21/0602 482/86
2012/0149536 A1 * 6/2012 Trimble ..... A63B 21/00065 53/469

(Continued)

FOREIGN PATENT DOCUMENTS

CA 2275082 6/2000
GB 2490595 B * 3/2013 ..... A63B 21/0602

(Continued)

OTHER PUBLICATIONS

Tidal Tank XL Yoga Sandbag with Water, Aqua Bag Weight, for sale on Amazon.com first available Nov. 19, 2019. (Year: 2019).*

*Primary Examiner* — Loan B Jimenez
*Assistant Examiner* — Jonathan A Dicuia

(57) ABSTRACT

A portable aquatic exercise device for performing callisthenic workouts using water weight includes an outer bag having an outer surface and an inner surface wherein the inner surface of the outer bag creates an interior. The outer bag has a top end and a bottom end. The top end has an aperture and the bottom end has an opening. The opening has a draw string positioning the opening from an open position to a closed position. A pair of ropes is coupled to the outer surface of the outer bag. An inner bag is positioned within the interior of the outer bag. An inside of the inner bag is fills with water wherein expanding against the outer bag. A hole of the inner bag has an insert. A cap is positioned on the aperture of the outer bag and engages by threading to the insert of the inner bag.

12 Claims, 5 Drawing Sheets

(56) References Cited

U.S. PATENT DOCUMENTS

| | | | | |
|---|---|---|---|---|
| 2014/0256522 | A1* | 9/2014 | Holt, IV | A63B 21/4035 482/110 |
| 2017/0021221 | A1* | 1/2017 | Hannula | A63B 21/4005 |
| 2020/0129801 | A1* | 4/2020 | Pace | A63B 21/0602 |

FOREIGN PATENT DOCUMENTS

| | | | | |
|---|---|---|---|---|
| JP | H1159782 | A * | 3/1999 | B65D 77/22 |
| WO | WO-2015150660 | A1 * | 10/2015 | B65D 75/5877 |

* cited by examiner

PORTABLE AQUATIC EXERCISE DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to portable exercise devices and more particularly pertains to a new portable exercise device for performing callisthenic workouts using water weight.

(2) Description of Related Art Including Information Disclosed Under 37 CFR 1.97 and 1.98

The prior art relates to portable exercise devices. The prior art relates to a variety of portable exercise devices configured for using water to add resistance weight for exercising. Known prior art lacks a portable exercise device having an opening on a bottom of an outer bag for inserting an inner bag within an interior of the outer bag prior to filling the inner bag with water to perform exercises with.

BRIEF SUMMARY OF THE INVENTION

An embodiment of the disclosure meets the needs presented above by generally comprising an outer bag being a durable material. The outer bag has an outer surface and an inner surface wherein the inner surface of the outer bag creates an interior. The outer bag has a top end and a bottom end. The top end has an aperture and the bottom end has an opening to the interior of the outer bag. The opening has a draw string being configured for positioning the opening from an open position to a closed position. A strip is position on the outer surface of the outer bag and has a measuring line. The measuring line is configured for indicating a level of capacity within the interior of the outer bag. A pair of ropes is coupled to the outer surface of the outer bag. The pair of ropes is configured for being grabbed by a respective one of a pair of hands of the user. An inner bag is positioned within the interior of the outer bag. The inner bag has a hole being configured for providing access to an inside of the inner bag. The inside of the inner bag is configured for infilling with water wherein expanding against the inner surface of the outer bag. The hole of the inner bag has an insert. A cap is positioned on the aperture of the outer bag and is configured for engaging by threading to the insert of the inner bag wherein enclosing the inside of the inner bag and retaining the inner bag in a fixed position relative to the outer bag.

Furthermore, a method for exercising with a portable aquatic device includes the step of inserting an inner bag within an opening of an outer bag. The user positions an insert of the inner bag flush with an aperture of the outer bag wherein nesting the inner bag within an interior of the outer bag. Subsequently, the user fills an inside of the inner bag with water, measuring the inside of the inner bag by using a strip positioned on the outer bag. A cap is positioned on the aperture of the outer bag prior to engaging by threading the cap to the insert of the inner bag wherein retaining the inner bag in a fixed position relative to the outer bag. The user tightens a draw string of the opening of the outer bag wherein enclosing the inner bag within the interior of the outer bag. Afterward, the user inserts a bar through a pair of loops of a pair of ropes of the outer bag.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
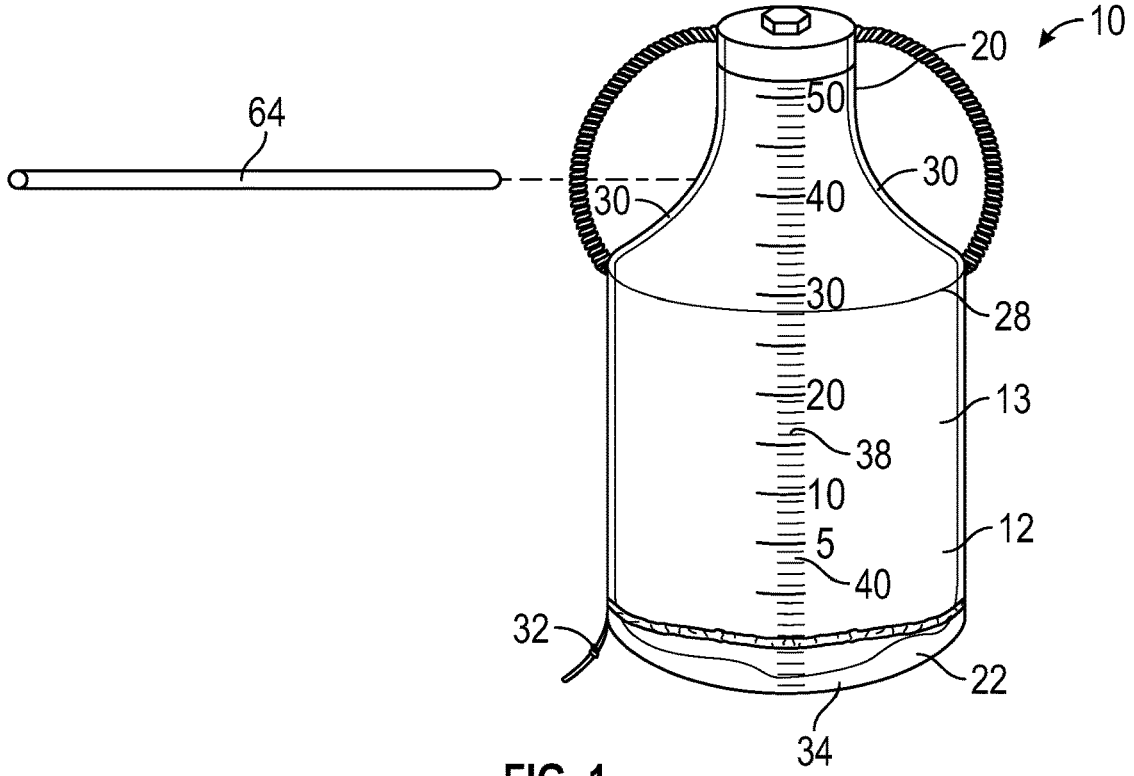
FIG. 1 is a top perspective view of a portable aquatic exercise device according to an embodiment of the disclosure.
Figure 2:
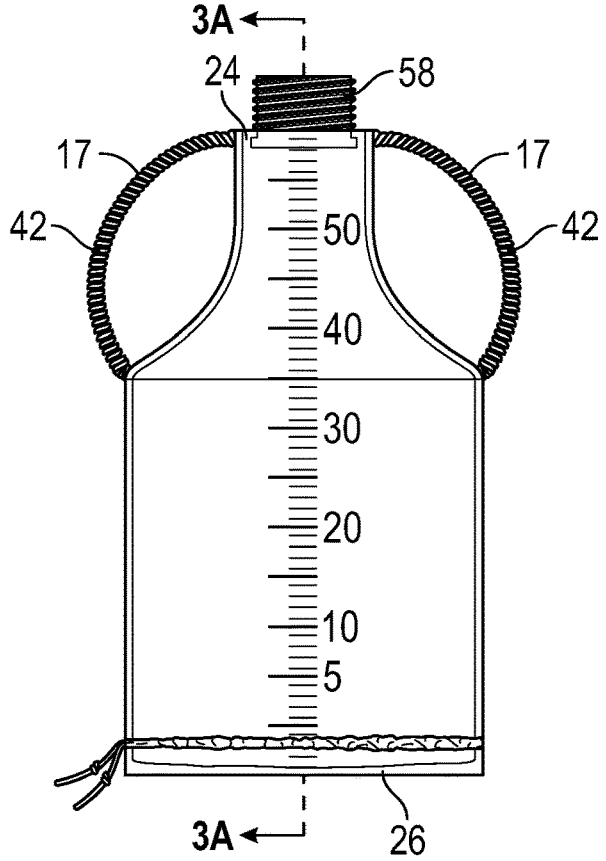
FIG. 2 is a front view of an embodiment of the disclosure.
Figure 3:
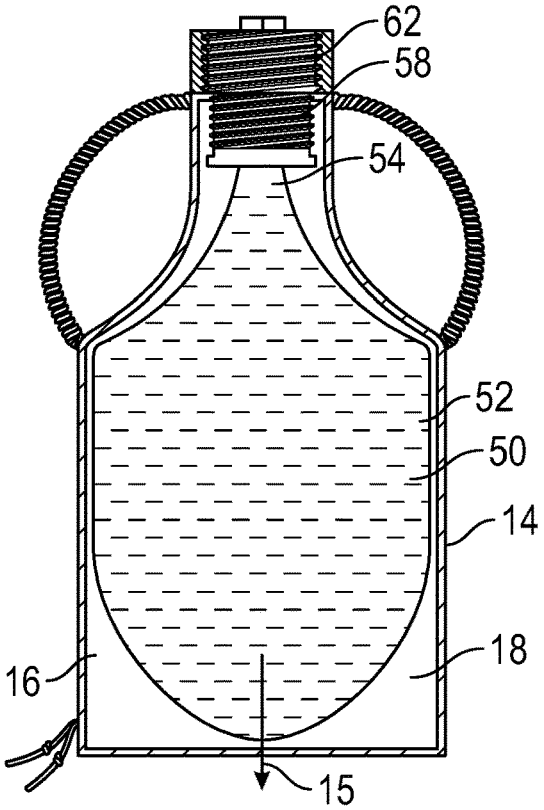
FIG. 3 is a cross-sectional view of an embodiment of the disclosure taken along Line 3A of FIG. 2.
Figure 4:
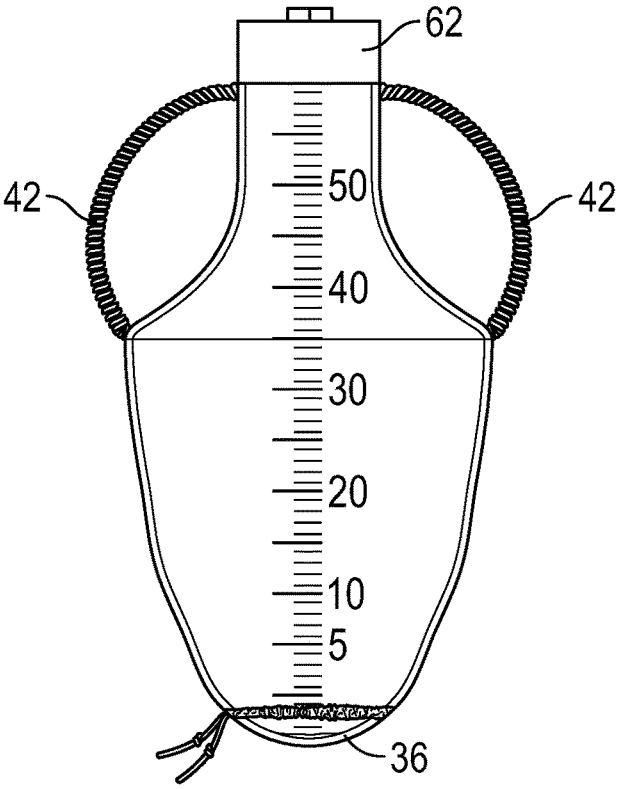
FIG. 4 is a front in-use view of an embodiment of the disclosure.
Figure 5:
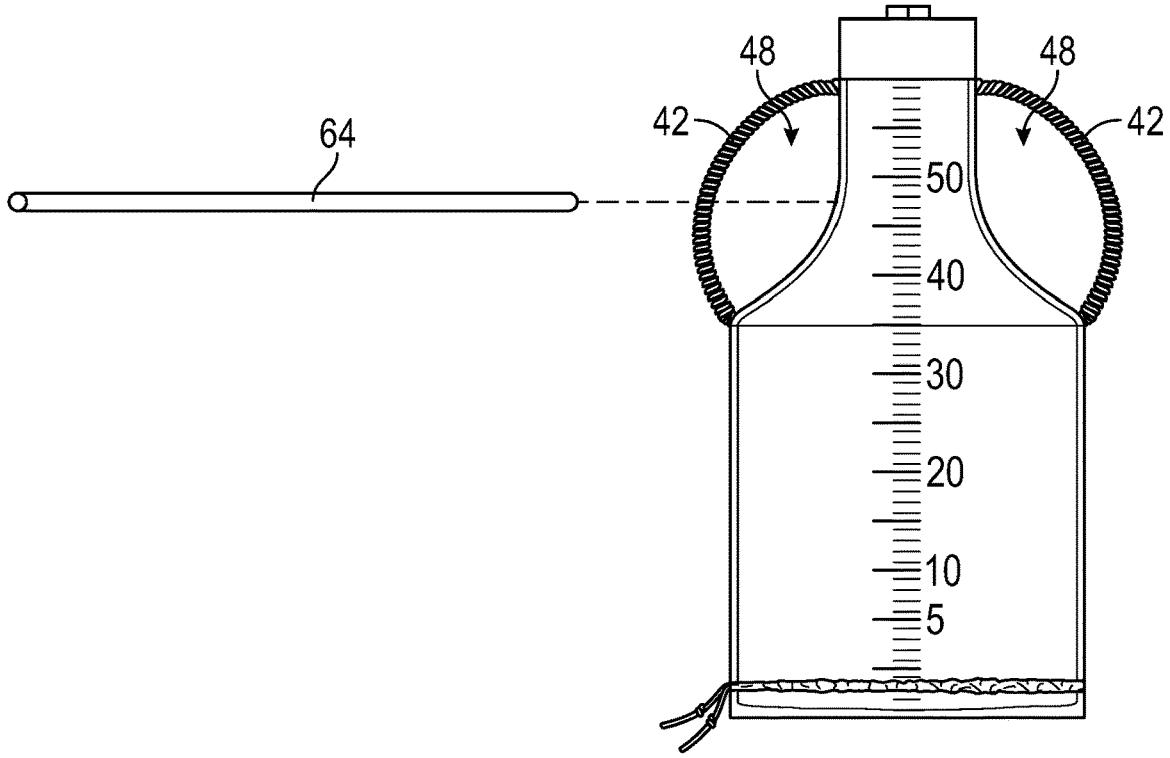
FIG. 5 is a partial exploded view of an embodiment of the disclosure.
Figure 6:
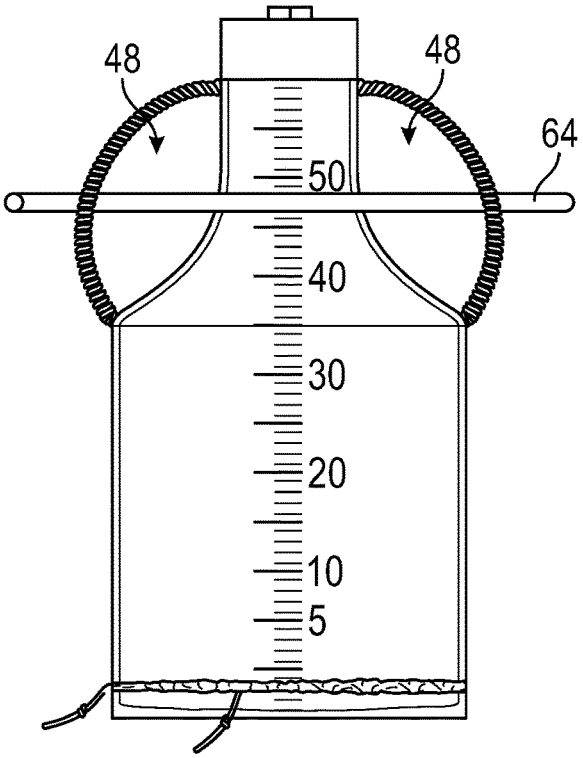
FIG. 6 is a front in-use view of an embodiment of the disclosure.
Figure 7:
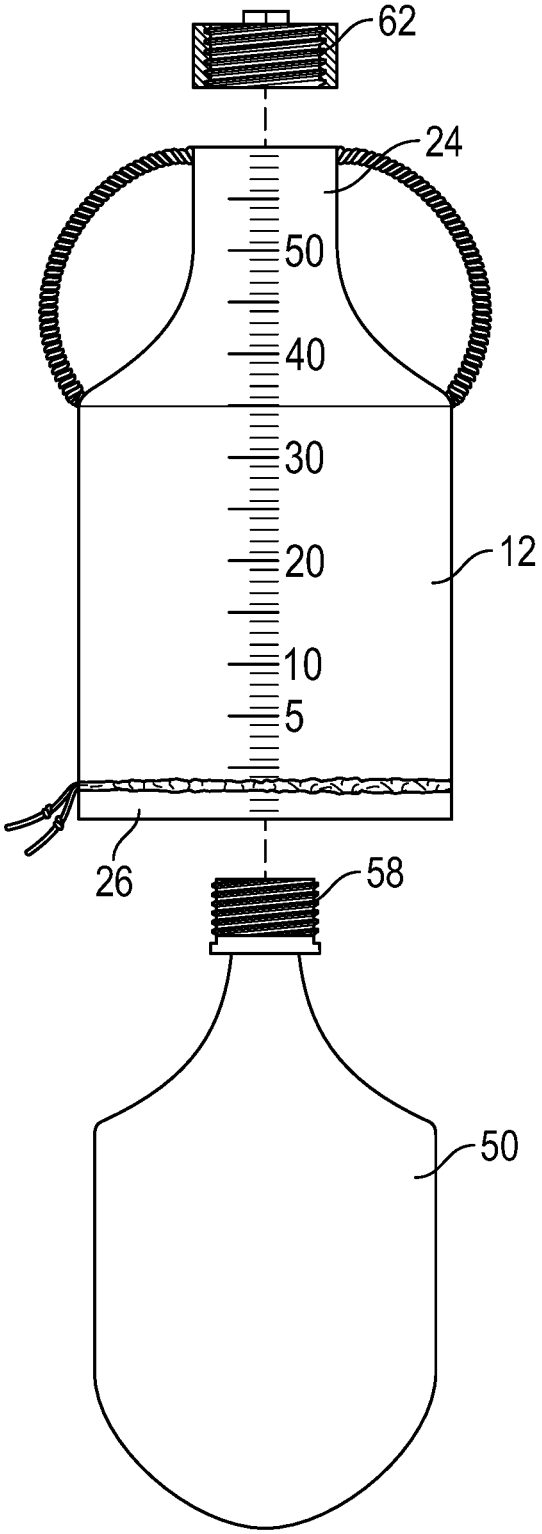
FIG. 7 is an exploded view of an embodiment of the disclosure.
Figure 8:
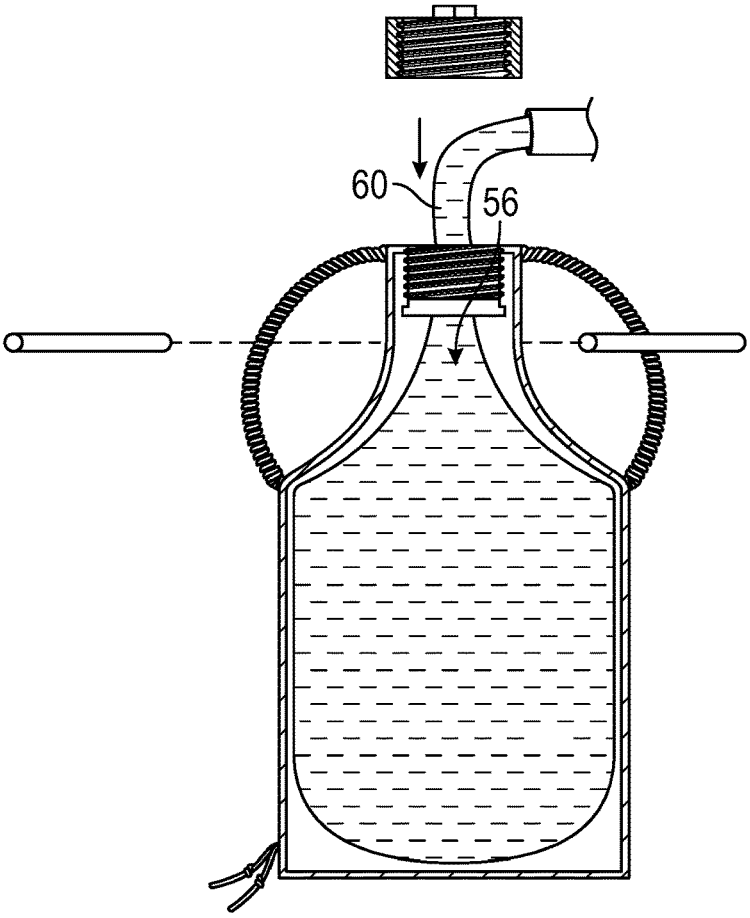
FIG. 8 is a detail view of an embodiment of the disclosure.
Figure 9:
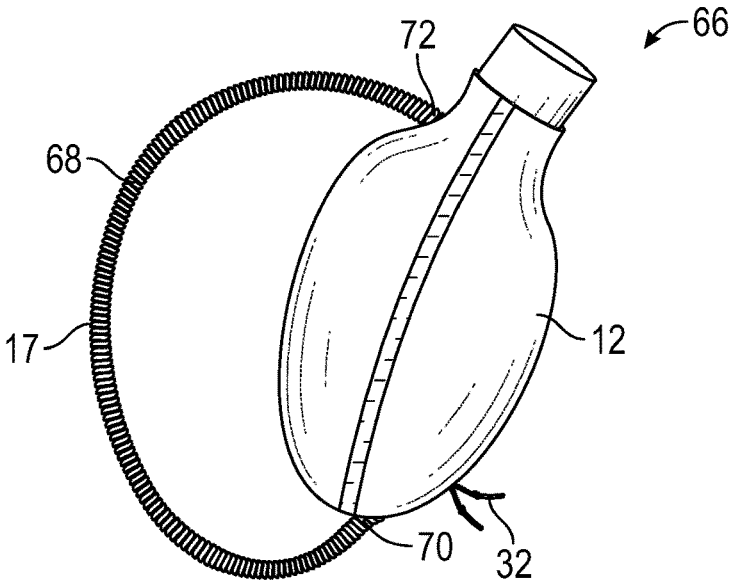
FIG. 9 is an alternate view of an embodiment of the disclosure.

With reference now to the drawings, and in particular to FIGS. 1 through 9 thereof, a new portable exercise device embodying the principles and concepts of an embodiment of the disclosure and generally designated by the reference numeral 10 will be described.

As best illustrated in FIGS. 1 through 9, the portable aquatic exercise device 10 generally comprises an outer bag 12. The outer bag 12 is a 13 durable material being configured for being resistant to rupturing from a weight force 15. The outer bag 12 has an outer surface 14 and an inner surface 16. The inner surface 16 of the outer bag 12 creates an interior 18 defining a space for an element to be positioned within. The outer bag 12 has a top end 20 and a bottom end 22. The top end 20 has an aperture 24 and the bottom end 22 has an opening 26 to the interior 18 of the outer bag 12. The aperture 24 is smaller in perimeter relative to the opening 26. Furthermore, the outer bag 12 has a center 28 and an inward curvature 30 from the center 28 to the aperture 24. The opening 26 has a draw string 32 being configured for positioning the opening 26 from an open position 34 to a closed position 36 wherein the closed position 36 encloses the interior 18 of the outer bag 23. A strip 38 is position on the outer surface 14 of the outer bag 12 from the opening 26 to the aperture 24 of the outer bag 12. The strip 38 has a measuring line 40 being configured for indicating a level of capacity within the interior 18 of the outer bag 12. The strip 38 is a transparent material being configured for is visible through wherein the user can determine the weight force upon the portable aquatic exercise device 10.

A pair of ropes 42 is coupled to the outer surface 14 of the outer bag 12. Each of the ropes 42 is a nylon rope 17 being configured for being supple and resistant to rupturing from the weight force 15. Each of the ropes 42 has a first end 44 and a second end 46. The first end 44 of each of the ropes 42 is positioned on the center 28 of the outer surface 14 of the outer bag 12. A second end 46 of each of the ropes 42 are coupled proximate to the aperture 24 of the outer surface 14 of the outer bag 12. The pair of ropes 42 is configured for being grabbed by a respective one of a pair of hands of the user. Additionally, the pair of ropes 42 defines a pair of loops 48 against the outer bag 12.

An inner bag 50 is positioned within the interior 18 of the outer bag 12. The inner bag 50 is a plastic material 52 being configured for being impervious and supple. The inner bag 50 has a hole 54 being configured for providing access to an inside 56 of the inner bag 50. The inside 56 defines an area for a fluid 60 to infill, wherein the inside 56 of the inner bag 50 is configured for infilling with water and expanding against the inner surface 16 of the outer bag 12. The hole 54 of the inner bag 50 has an insert 58. The insert 58 has a male external threading and is configured for being positioned flush to the aperture 24 of the outer bag 12.

A cap 62 is positioned on the aperture 24 of the outer bag 12. The cap 62 has a tubular body and a top that encloses the aperture 24 of the outer bag 12. The cap 62 has a female internal threading being complementary to the male external threading of the insert 58 of the inner bag 50. The cap 62 is configured for engaging by threading to the insert 58 of the inner bag 50 wherein enclosing the inside 56 of the inner bag 50 and retaining the inner bag 50 in a fixed position relative to the outer bag 12.

A bar 64 is configured for assisting in exercising with the portable aquatic exercise device 10. The bar 64 is a steel material being configured for being resistant to damage by the weight force 15 when in-use. The bar 64 is configured for being one meter in length. The bar 64 is inserted between the pair of loops 48 of the pair of ropes 42 of the outer bag 12 for the user to perform a variety of exercises with, such as performing curl-up exercises. The bar 64 is removable from the pair of loops 48 wherein the user can perform the variety of exercises without the bar 64.

An alternate embodiment 66 of the portable aquatic exercise device 10 lacks the pair of ropes 42. Rather, the alternate embodiment 66 has a rope 68. The rope 68 is the nylon material 17 and includes a first end 70 and a second end 72. The first end 70 is positioned proximate to the opening 26 of the outer surface 14 of the outer bag 12, whereas the second end 72 is positioned proximate to the aperture 24 of the outer surface 14 of the outer bag 12. The alternate embodiment 66 is meant to resemble a waist bag. The alternate embodiment 66 is a smaller-scale version of the portable aquatic exercise device 10.

In use, the user inserts the inner bag 50 within the opening 26 of an outer bag 12. The user positions the insert 58 of the inner bag 50 flush with the aperture 24 of the outer bag 12 wherein nesting the inner bag 50 within the interior 18 of the outer bag 12. The user fills the inside 56 of the inner bag 50 with the fluid 60 and measures the inside 56 of the inner bag 50 by using the strip 38 positioned on the outer bag 12. The user then positions the cap 62 on the aperture 24 of the outer bag 12 and engages by threading the cap 62 to the insert 58 of the inner bag 50 wherein retaining the inner bag 50 in a fixed position relative to the outer bag 12. Subsequently, the user tightens the draw string 32 of the opening 26 of the outer bag 12 wherein enclosing the inner bag 50 within the interior 18 of the outer bag 12. The user can then insert the bar 64 through a pair of loops 48 of a pair of ropes 42 of the outer bag 12 to perform exercises. The user can remove the bar 64 from the pair of loops 48 to perform exercises by grabbing the pair of ropes 42.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable aquatic exercise device configured for infilling with water to provide resistance weight, the portable aquatic exercise device comprising:

an outer bag being a durable material, said outer bag having an outer surface and an inner surface, said inner surface of said outer bag creating an interior, said outer bag having a top end and a bottom end, said top end having an aperture, said bottom end having an opening to said interior of said outer bag, said opening having a draw string, said draw string being configured for positioning said opening from an open position to a closed position, a strip positioned on said outer surface of said outer bag, said strip having a measuring line, said measuring line being configured for indicating a level of capacity within said interior of said outer bag;

a pair of ropes being coupled to said outer surface of said outer bag, said pair of ropes being configured for being grabbed by a respective one of a pair of hands of the user;

an inner bag being positioned within said interior of said outer bag, said inner bag having a hole, said hole being configured for providing access to an inside of said inner bag, said inside of said inner bag being configured for infilling with water wherein expanding against said inner surface of said outer bag, said hole of said inner bag having an insert; and a cap being positioned on said aperture of said outer bag, said cap being configured for engaging by threading to said insert of said inner bag wherein enclosing said inside of said inner bag and retaining said inner bag in a fixed position relative to said outer bag.

2. The portable aquatic exercise device of claim 1, further comprising said interior defining a space for an element to be positioned within.

3. The portable aquatic exercise device of claim 2, further comprising said aperture being smaller in perimeter relative to said opening, said outer bag having a center, said outer bag having an inward curvature from said center to said aperture.

4. The portable aquatic exercise device of claim 3, further comprising said closed position enclosing said interior of said outer bag.

5. The portable aquatic exercise device of claim 4, further comprising said strip being positioned from said opening to said aperture of said outer bag, said strip being a transparent material, said transparent material being configured for being visible through.

6. The portable aquatic exercise device of claim 5, further comprising each rope of said pair of ropes being a nylon rope, each rope of said pair of ropes having a first end and a second end, said first end of each rope of said pair of ropes being positioned on said center of said outer surface of said outer bag, a second end of each rope of said pair of ropes being coupled proximate to said aperture of said outer surface of said outer bag, said pair of ropes defining a pair of loops against said outer bag.

7. The portable aquatic exercise device of claim 6, further comprising said inside defining an area for a fluid to infill.

8. The portable aquatic exercise device of claim 7, further comprising said insert having a male external threading, said insert being configured for being positioned flush to said aperture of said outer bag.

9. The portable aquatic exercise device of claim 8, further comprising said cap having a tubular body, said cap having a top, said cap having a female internal threading, said female internal threading being complementary to said male external threading of said insert of said inner bag.

10. The portable aquatic exercise device of claim 9, further comprising a bar being configured for assisting in exercising with said portable aquatic exercise device, said bar being a steel material, said bar being inserted between said pair of loops of said pair of ropes of said outer bag.

11. The portable aquatic exercise device of claim 1, further comprising said inner bag being a plastic material.

12. A method for exercising with a portable aquatic device, the method including the step of:

inserting an inner bag within an opening of an outer bag;

positioning an insert of said inner bag flush with an aperture of said outer bag wherein nesting said inner bag within an interior of said outer bag;

infilling an inside of said inner bag with water, measuring said inside of said inner bag by using a strip positioned on said outer bag;

positioning a cap on said aperture of said outer bag, engaging by threading said cap to said insert of said inner bag wherein retaining said inner bag in a fixed position relative to said outer bag;

tightening a draw string of said opening of said outer bag wherein enclosing said inner bag within said interior of said outer bag; and inserting a bar through a pair of loops of a pair of ropes of said outer bag.

* * * * *